US006840166B2

(12) United States Patent
Jeter et al.

(10) Patent No.: US 6,840,166 B2
(45) Date of Patent: Jan. 11, 2005

(54) MANDREL TRIP APPARATUS

(75) Inventors: Jim Jeter, Jacksonville, FL (US); Frank Lee, Jacksonville, FL (US)

(73) Assignee: Machine Engineering, Inc., Jacksonville, FL (US)

( * ) Notice: Subject to any disclaimer, the term of this patent is extended or adjusted under 35 U.S.C. 154(b) by 0 days.

(21) Appl. No.: 10/460,818

(22) Filed: Jun. 12, 2003

(65) Prior Publication Data

US 2004/0045464 A1 Mar. 11, 2004

Related U.S. Application Data

(60) Provisional application No. 60/388,331, filed on Jun. 12, 2002.

(51) Int. Cl.[7] ..... B41F 17/08; B41F 13/24

(52) U.S. Cl. ..... 101/38.1; 101/39; 101/40; 101/40.1; 101/247

(58) Field of Search ..... 101/38.1, 39, 40, 101/40.1, 247

(56) References Cited

U.S. PATENT DOCUMENTS

| | | | | |
|---|---|---|---|---|
| 3,356,019 A | * | 12/1967 | Zurick | 101/39 |
| 3,521,554 A | | 7/1970 | Zurick | |
| 3,563,170 A | | 2/1971 | Cvacho et al. | |
| 3,665,853 A | | 5/1972 | Hartmeister et al. | |
| 3,851,579 A | | 12/1974 | Zurick | |
| 4,018,151 A | | 4/1977 | Urban et al. | |
| 4,037,530 A | | 7/1977 | Sirvet | |
| 4,140,053 A | * | 2/1979 | Skrypek et al. | 101/40 |
| 4,267,771 A | * | 5/1981 | Stirbis | 101/40 |
| 4,370,943 A | * | 2/1983 | Watanabe et al. | 118/218 |
| 4,441,418 A | | 4/1984 | Hahn | |
| 4,491,613 A | | 1/1985 | Hahn | |
| 4,498,387 A | | 2/1985 | Stirbis | |
| 4,693,178 A | | 9/1987 | Hudec | |
| 4,750,420 A | | 6/1988 | Shriver | |
| 4,773,326 A | | 9/1988 | Hudec | |
| 4,821,638 A | | 4/1989 | Uithoven | |
| 4,889,050 A | * | 12/1989 | Meador | 101/38.1 |
| 5,111,742 A | * | 5/1992 | DiDonato et al. | 101/40 |
| 5,148,742 A | | 9/1992 | Stirbis et al. | |
| 5,233,922 A | * | 8/1993 | Stirbis et al. | 101/363 |
| 5,370,047 A | * | 12/1994 | Compton | 101/216 |
| 5,572,927 A | * | 11/1996 | Sirvet | 101/40 |
| 5,799,574 A | * | 9/1998 | Williams et al. | 101/40 |
| 5,970,865 A | * | 10/1999 | Horth et al. | 101/40 |
| 6,167,805 B1 | * | 1/2001 | Williams et al. | 101/40 |
| 6,651,552 B1 | * | 11/2003 | Didonato | 101/40 |

* cited by examiner

*Primary Examiner*—Andrew H. Hirshfeld
*Assistant Examiner*—Marvin P Crenshaw
(74) *Attorney, Agent, or Firm*—Thomas C. Saitta

(57) ABSTRACT

An independent mandrel trip system wherein a mandrel support block retaining a mandrel is connected to a shaft mounting block in a manner such that the mandrel support block can be reciprocatingly retracted and extended relative to the shaft mounting block in a direction perpendicular to the longitudinal axis of the mandrel.

16 Claims, 3 Drawing Sheets

MANDREL TRIP APPARATUS

This application claims the benefit of U.S. Provisional Patent Application Ser. No. 60/388,331, filed Jun. 12, 2002.

BACKGROUND OF THE INVENTION

The invention relates generally to the field of equipment that incorporates multiple mandrels for temporarily receiving work pieces upon which a process must be performed, where it is sometimes necessary to quickly retract or reposition a mandrel. More particularly, the invention relates to such equipment wherein the mandrel needs to be retracted in a direction perpendicular to the longitudinal axis of the mandrel.

A mandrel is typically a cylindrical member used to retain another object during a processing operation. For example, in typical equipment used in the printing of beverage cans, a large number of freely rotating mandrels are mounted about the perimeter of a large rotating drum. A blank can is placed onto each mandrel at a loading station, and the drum then rotates the loaded mandrel past an applicator or printing mechanism, such as a rotating wheel having a series of inked printing blankets. The can loaded onto the mandrel contacts the printing blanket and ink is transferred in a precise manner. After inking, a varnish or lacquer is often applied as a sealant in the same manner. This type of equipment is designed to handle large quantities of cans in a very short time. For example, a typical decorating machine of the type described having from 24 to 36 equally spaced mandrels may produce over 2000 printings per minute.

In the event a can is not properly loaded onto a mandrel, ink or varnish will transfer onto the mandrel itself due to the thinness of the can wall and the minimal tolerances present in the equipment. If this occurs, ink or varnish will be transferred to the interior of the next blank can loaded onto the mandrel unless the equipment is shut down and cleaned. Where production totals of hundreds of thousands of cans per day are required, a shut down for even a few minutes is costly.

Because of this, when a blank can is not properly loaded onto a mandrel, the decorating machine is designed to detect this condition by known sensing means and to trigger a trip or can skip event. The trip event typically consists of the rotating applicator drum or the can handling component being shifted slightly away from the printing blanket component so that ink is not transferred onto an empty mandrel. In current equipment, a trip event may result in incomplete printing of 3 or more cans preceding and following the empty mandrel, such that these cans will be rejected by quality control. In addition, the current mechanism for enacting the trip event requires movement of large sections of the equipment, which entails complicated mechanisms that are susceptible to failure and wear. Examples of trip structures and systems designed to address the problem of unloaded or misloaded mandrels are shown in U.S. Pat. No. 3,665,853 to Hartmeister et al., U.S. Pat. No. 4,441,418 to Hahn, and U.S. Pat. No. 4,491,613 to Hahn, which show equipment wherein the applicator or printing means is retracted in response to occurrence of a trip event, and U.S. Pat. No. 3,563,170 to Cvacho et al., U.S. Pat. No. 3,851,579 to Zurick, U.S. Pat. No. 4,018,151 to Urban et al., and U.S. Pat. No. 4,037,530 to Sirvet, which show equipment wherein the mandrel support means is retracted in response to the trip event. These patents provide an overview of the general problem and descriptions of representative equipment found in the industry, and therefore the disclosure of these references is incorporated herein by reference.

The mechanisms utilized in the known art to retract either the mandrel support members or the printing members are excessively complicated and prone to mechanical failure or failure due to misadjustment, typically utilized pivoting arms, spring members and the like that require the entire mandrel support members to move relative to the rotating drum upon which they are mounted. It is an object of this invention to provide an independent mandrel trip apparatus having an operational mechanism of improved efficiency and durability, wherein a trip event only affects the non-loaded mandrel, in that each mandrel mounting block is provided with means to retract its mandrel without effect to the adjacent mandrels. It is a further object to provide such an apparatus wherein the mounting blocks are directly fixed to the rotating drum without need to provide for movement of the mounting block relative to the drum, and wherein the mandrel mounting means can be readily retrofitted onto existing decorating machines or the like. These objects, along with objects not expressly set forth in this section, will become apparent from the disclosure to follow.

SUMMARY OF THE INVENTION

The invention is an independent mandrel trip apparatus for use with decorating machines or other equipment utilizing multiple mandrels adapted to temporarily receive and retain work pieces, such as a blank can to be imprinted for example, where retraction or repositioning of individual mandrels from an active position to an inactive position is necessitated by certain events, such as the non-loading or misleading of a particular mandrel. The invention is such an apparatus comprising a two piece mandrel block assembly, wherein the base block of the mandrel assembly is adapted to be mounted onto the circumference of a rotating drum or like member for properly positioning the mandrel for desired operations, such as printing or coating of a can mounted onto the mandrel for example, and wherein the upper block of the mandrel assembly is a mandrel support block retaining the mandrel itself. The base block and the mandrel support block are joined such that linear reciprocal movement of the mandrel support block is possible relative to the base block, such that the mandrel may be repositioned in a direction perpendicular to the longitudinal axis of the mandrel. Movement of the support block is effected by movement of a cylinder housing in relation to a fixed piston, the cylinder housing being mounted such that movement parallel to the mandrel longitudinal axis occurs in response to pressure changes of fluid disposed about the fixed piston. Linear movement of the cylinder housing moves cylinder cam rollers which are disposed in cam slots attached to the support mandrel block, such that movement of the cylinder housing in one direction extends the support mandrel block and mandrel relative to the base block, while movement of the cylinder housing in the other direction retracts the support mandrel block and mandrel relative to the base block. In routine operation, the mandrel is disposed at the extended position, but in the event of a non-loading the trip system is activated such that the support mandrel block and mandrel are retracted.

DETAILED DESCRIPTION OF THE INVENTION

Figure 1:
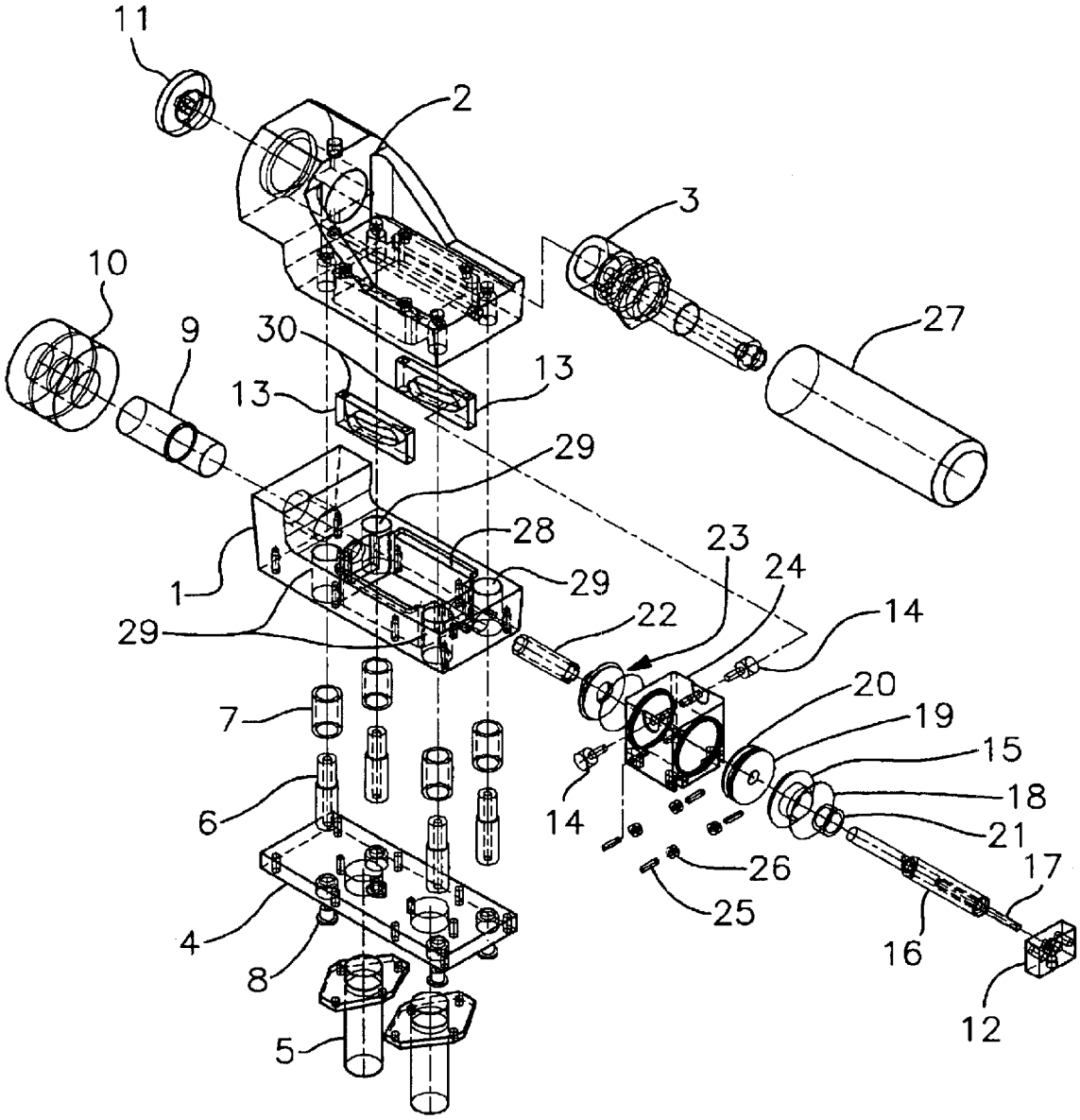
FIG. 1 is an exploded view of the invention.
Figure 2:
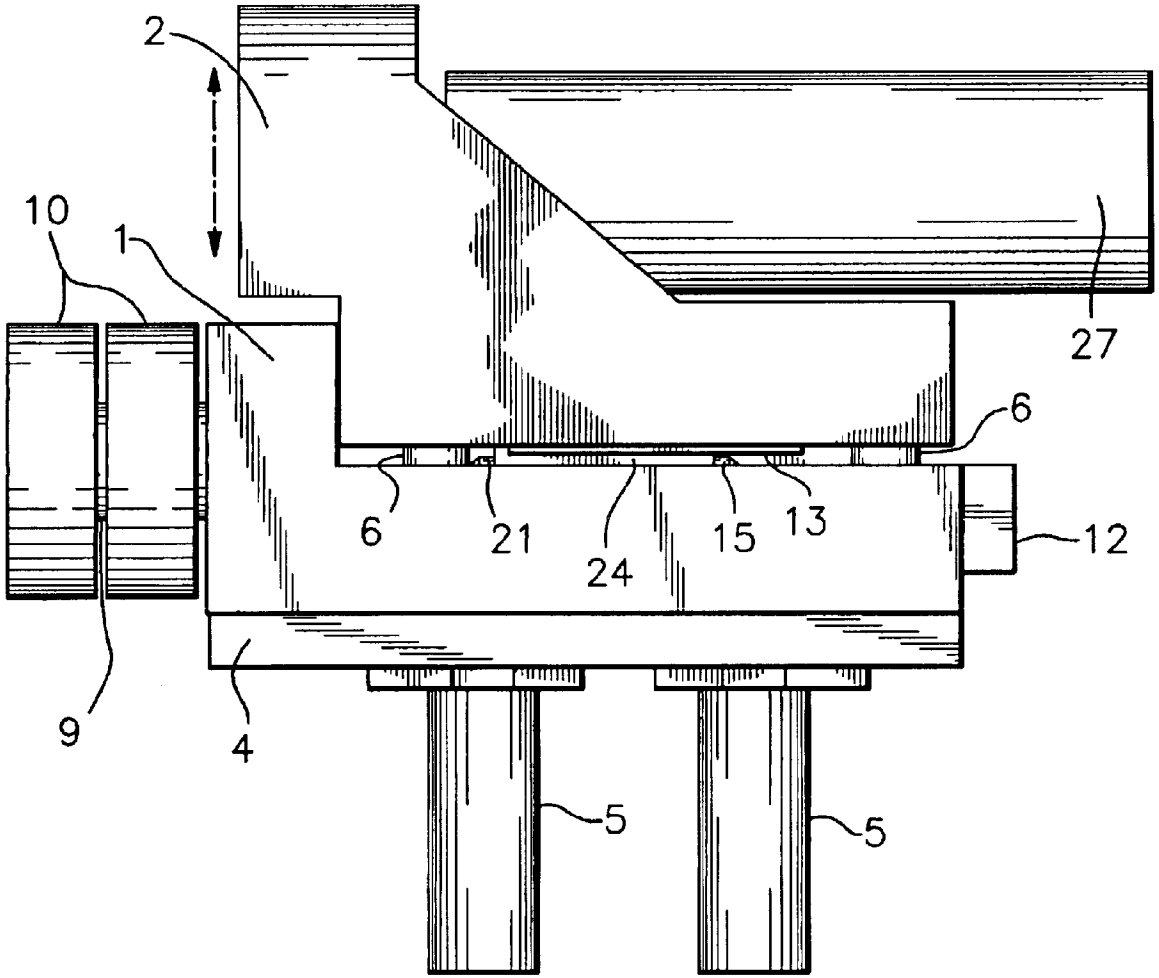
FIG. 2 is a side view of the invention.
Figure 4:
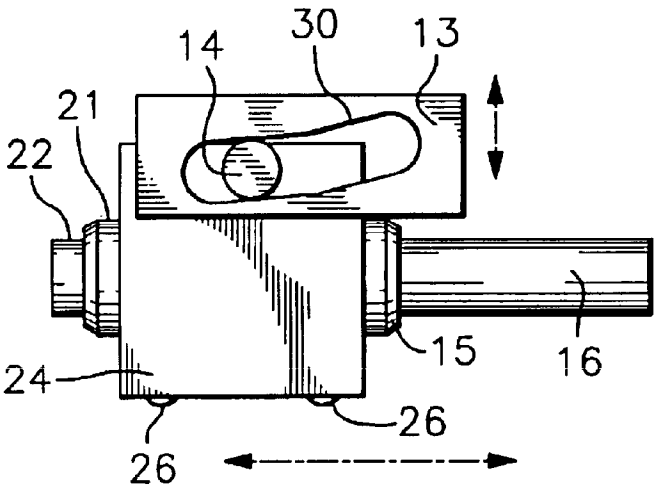
FIG. 4 is a side view of certain elements of the invention, showing the trip actuating means for extending and retracting the support mandrel portion.
Figure 3:
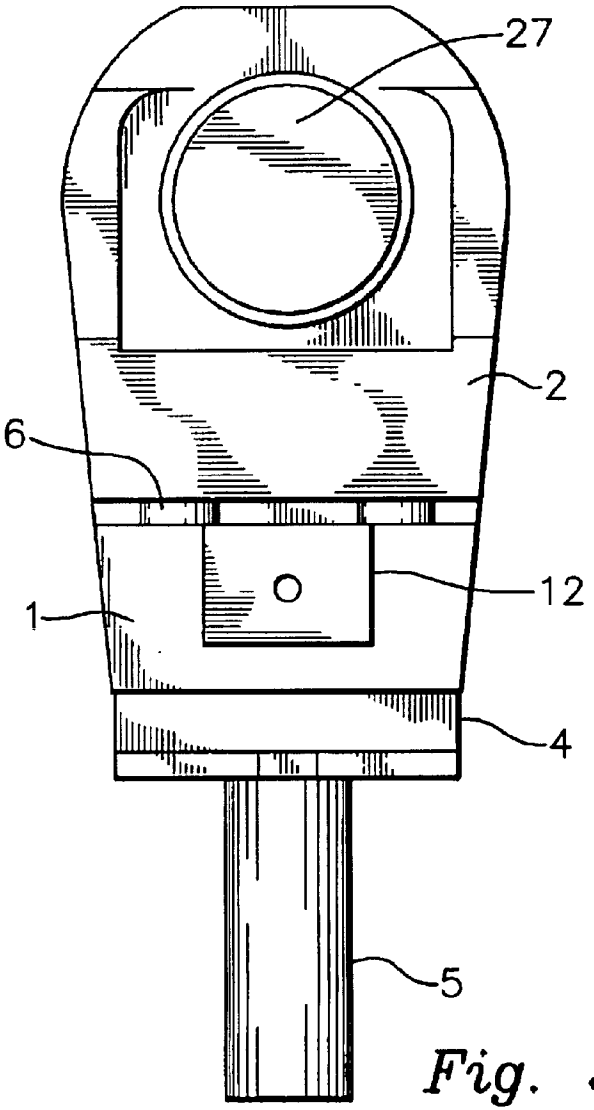
FIG. 3 is an end view of the invention.

With reference to the drawings, the invention will now be described in detail with regard for the best mode and the preferred embodiment or embodiments. In a most general sense, the invention is a mandrel trip apparatus, assembly or system comprising trip means in the form of a mandrel block assembly to effectuate retraction or repositioning of a mandrel in a direction perpendicular to the longitudinal axis of the mandrel in response to a sensing of a trip event, the mandrel being adapted to temporarily receive a work piece thereon for subsequent processing. The mandrel block assembly comprises two main components, a base or shaft mounting block assembly and a mandrel support block assembly which are separable by mandrel support block movement means such that the separation distance between the base block and the mandrel support block is changed responsive to a trip event in order to retract the mandrel. The invention is especially suited for use in a can printing system wherein blank cans are mounted onto the mandrels for imprinting and varnishing, but it is to be understood that the application of the invention is not limited to this type of operation.

The base block assembly comprises a generally rectangular base plate 4 which is adapted to be mounted to a rotary drum or like member of a decorating machine or the like (not shown). Cylindrical guide shafts 5 are secured to the underside of the base plate 4 for proper positioning of the base plate 4. A shaft mounting block 1 having a generally L-shaped configuration in side view is secured to the base plate 4 by suitable means, such as mechanical fasteners. The shaft mounting block 1 is provided with a generally rectangular central cavity 28 for receipt of the cylinder housing 24 and related elements. The shaft mounting block 1 is also provided with a plurality of bores 29 for receipt of guide bushings 7 and guide pins 6 which define the direction of movement of the mandrel support block 2. Stop nuts 8 are provided on the underside of the base plate 4 to limit travel distance of the mandrel support block 2. A cam roller shaft 9 and mounting block cam roller 10 extend from the rear of the shaft mounting block 1 to effectuate repositioning of the shaft mounting block 1 as required by the equipment.

Mandrel trip operator or actuator means, i.e., means to move the mandrel support block 2 relative to said shaft mounting block 1, are provided such that the mandrel support block 2 is reciprocatingly movable so as to be retractable and extendable relative to the shaft mounting block 1 in the direction perpendicular to the longitudinal axis of the mandrel 3. The mandrel trip actuator means comprises a cylinder housing 24 mounted onto rollers 26 by roller pins 25 and placed within the generally rectangular cavity 28, such that the cylinder housing 24 is capable of reciprocal linear movement relative to the shaft mounting block 1, in the direction parallel to the central axis of the mandrel 27. The height of the cylinder housing 24 is such that it extends above and from the cavity 28. A fixed piston 19 having a piston seal 20 is positioned within and extending through the cylinder housing 24, the piston 19 mounted onto an inner cylinder shaft 22 and an outer cylinder shaft 16, which are retained within an assembly comprising a cylinder rod seal 23, a cylinder cap 15, a retaining ring 18, bushing 21 and cylinder shaft retainer 12. The piston 19 is aligned parallel to the longitudinal axis of the mandrel 27. In this manner the cylinder housing 24 is sealed such that fluid, whether hydraulic or pneumatic, cannot escape from the housing during reciprocal motion of the cylinder housing 24. A tube 17 is provided for fluid transfer, such as hydraulic fluid, air or the like, to either side of the stationary piston 19. Transfer of fluid from one side of the piston 19 to the other results in linear movement of the cylinder housing 24. Alternatively, the trip means can be electrically effectuated. Cylinder housing cam rollers 14 are provided on opposite sides of the cylinder housing 24, with the cylinder housing cam rollers 14 being positioned preferably outside of the cavity 28.

The mandrel support block 2 is mounted onto the guide pins 6 that are of a length sufficient to extend through the bores 29 of the shaft mounting block 1. The mandrel support block 2 retains a cylindrical mandrel 27 mounted onto a mandrel shaft 3 retained by a mandrel shaft retainer 11, with the mandrel 27 mounted in a manner that allows for free rotation about its longitudinal axis. A pair of cam slot flange members 13 are attached to the underside of the mandrel support block 2. A matching curved, slanted or angularly configured slot 30 is disposed in each flange member 13 to receive the cylinder cam rollers 26 mounted on the cylinder housing 24. The slots 30 of the cam slot members 13 are disposed such that one end is higher than the other relative to the plane containing the base plate 4. As shown in the figures, the forward end of the slots 30 are disposed higher than the rearward end, where the forward direction is taken to be the direction toward the free end of the mandrel 27.

In the normal extended and operational position, the cylinder housing 24 is linearly disposed rearward such that the cylinder cam rollers 26 are at the lower end of the cam slots 13. This position is held by fluid pressure within the cylinder housing 24, wherein the fluid is supplied in known manner through typical hydraulic or pneumatic systems. Appropriate fluid communication ports and conduits are provided to deliver fluid into the cylinder housing 24 in order to effect its linear movement relative to the fixed piston 19. This results in the mandrel support block 2 being retained in the extended position relative to the shaft mounting block 1, such that the separation between the mandrel support block 2 and the shaft mounting block 1 is at its greatest. In the event of trip event, wherein sensing means of known type sense the non-loading or misleading of a can or other work piece onto the mandrel 27, the pressure within the cylinder housing 24 is diverted to the opposite side of the fixed piston 19, causing the cylinder housing 24 to advance forward. As this occurs, the cylinder cam rollers 26 advance to occupy the raised end of the cam slots 30, which causes the mandrel support block 2 to lower or retract relative to the shaft mounting block 1. The retraction of the mandrel 27 in the direction perpendicular to its central axis provides sufficient separation between the surface of the mandrel 27 and the printing means, for example, whereby ink will not be transferred onto mandrel 27. Extension of the shaft mounting block 1 after the printing station is passed is effected by again reversing the pressure within the cylinder housing 24 relative to the fixed piston 9, such that the cylinder housing 24 retreats and the cylinder cam rollers 14 return to the lower end of the cam slots 30.

In this manner the mandrel 27 can be retracted independently of the other mandrels on the rotary drum. The mandrel support block 2 moves relative to the shaft mounting block 1, but the components are retained in precise alignment and the mandrel support block 2 is returned to the precise extended position after each trip event.

It is contemplated that equivalents and substitutions to certain elements set forth above may be obvious to those skilled in the art without straying from the function and intent of the invention, and therefore the true definition and scope of the invention is to be as set forth in the following claims.

We claim:

1. A mandrel trip apparatus comprising a mandrel support block retaining a mandrel, said mandrel being cylindrical and having a longitudinal axis, wherein said mandrel support block is connected to a shaft mounting block in a manner such that said mandrel support block is reciprocatingly movable relative to the shaft mounting block in the direction perpendicular to said longitudinal axis of said mandrel, and further comprising mandrel trip actuator means comprising a piston and a cylinder housing receiving said piston, wherein said cylinder housing reciprocates in the direction parallel to said longitudinal axis of said mandrel.

2. The apparatus of claim 1, further comprising at least one slot disposed on said mandrel support block and at least one cam roller connected to said cylinder housing, wherein said at least one cam roller is positioned within said at least one slot such that movement of said cylinder housing results in movement of said mandrel support block relative to said shaft mounting block.

3. The apparatus of claim 2, wherein said mandrel trip actuator operates hydraulically.

4. The apparatus of claim 2, said mandrel support block further comprising two cam slot flange members positioned about said cylindrical housing, wherein said at least one slot comprises two slots and said at least one cam roller comprises two cam rollers, wherein one of said slots is disposed in each of said cam slot flange members and one of said cam rollers is disposed in each of said slots.

5. The apparatus of claim 1, further comprising bores disposed in said shaft mounting block and guide pins connected to said mandrel support block, wherein said guide pins are received by said bores and define the direction of movement of said mandrel support block.

6. The apparatus of claim 1, further comprising a cavity disposed in said shaft mounting block, wherein said cylinder housing and said piston are positioned within said cavity.

7. The apparatus of claim 1, said shaft mounting block further comprising a cam roller shaft and a mandrel block cam roller.

8. In an apparatus comprising a cylindrical mandrel having a longitudinal axis and adapted to receive a work piece thereon upon which a process is to be effected, wherein it is required under certain conditions that the mandrel be reciprocatingly moved from an active position to an inactive position, the apparatus further comprising sensing means to actuate such reciprocal movement, the improvement comprising:

a mandrel support block retaining said mandrel and connected to a shaft mounting block in a manner such that said mandrel support block is reciprocatingly movable relative to the shaft mounting block in the direction perpendicular to said longitudinal axis of said mandrel, and further comprising a mandrel trip actuator means comprising a piston and a cylinder housing receiving said piston, wherein said cylinder housing reciprocates in the direction parallel to said longitudinal axis of said mandrel.

9. The apparatus of claim 8, further comprising at least one slot disposed on said mandrel support block and at least one cam roller connected to said cylinder housing, wherein said at least one cam roller is positioned within said at least one slot such that movement of said cylinder housing results in movement of said mandrel support block relative to said shaft mounting block.

10. The apparatus of claim 9, wherein said mandrel trip actuator operates hydraulically.

11. The apparatus of claim 9, said mandrel support block further comprising two cam slot flange members positioned about said cylindrical housing, wherein said at least one slot comprises two slots and said at least one cam roller comprises two cam rollers, wherein one of said slots is disposed in each of said cam slot flange members and one of said cam rollers is disposed in each of said slots.

12. The apparatus of claim 8, further comprising bores disposed in said shaft mounting block and guide pins connected to said mandrel support block, wherein said guide pins are received by said bores and define the direction of movement of said mandrel support block.

13. The apparatus of claim 8, further comprising a cavity disposed in said shaft mounting block, wherein said cylinder housing and said piston are positioned within said cavity.

14. The apparatus of claim 8, said shaft mounting block further comprising a cam roller shaft and a mandrel block cam roller.

15. A mandrel trip apparatus comprising:

a mandrel support block retaining a mandrel, said mandrel being cylindrical and having a longitudinal axis, connected to a shaft mounting block in a manner such that said mandrel support block is reciprocatingly movable relative to the shaft mounting block in the direction perpendicular to said longitudinal axis of said mandrel;

a mandrel trip actuator means comprising a piston and a cylinder housing, said cylinder housing adapted to reciprocate in the direction parallel to said longitudinal axis of said mandrel;

two slots disposed on said mandrel support block; and two cam rollers connected to said cylinder housing, wherein said cam rollers are positioned within said slots such that movement of said cylinder housing results in movement of said mandrel support block relative to said shaft mounting block.

16. The apparatus of claim 15, further comprising bores disposed in said shaft mounting block and guide pins connected to said mandrel support block, wherein said guide pins are received by said bores and define the direction of movement of said mandrel support block; and a cavity disposed in said shaft mounting block, wherein said cylinder housing and said piston are positioned within said cavity.

* * * * *